United States Patent [19]

Olsen

[11] 3,973,502

[45] Aug. 10, 1976

[54] TUBE PRIMER

[76] Inventor: Charles R. Olsen, 307 Conestoga Way, Suite 37, Eaglesville, Pa. 19408

[22] Filed: July 12, 1974

[21] Appl. No.: 487,896

[52] U.S. Cl. ..... 102/86.5; 102/29

[51] Int. Cl.[2] ..... F42C 19/10

[58] Field of Search ..... 102/27, 29, 45, 70, 102/86.5; 89/1 B

[56] References Cited

UNITED STATES PATENTS

| | | | |
|---|---|---|---|
| 1,310,844 | 7/1919 | Semple | 102/70 |
| 1,491,000 | 4/1924 | Brandt et al. | 102/70 |
| 2,785,633 | 3/1957 | Ewing et al. | 102/86.5 |
| 3,911,823 | 10/1975 | Murray et al. | 102/86.5 |

*Primary Examiner*—Verlin R. Pendegrass
*Attorney, Agent, or Firm*—McCormick, Paulding & Huber

[57] ABSTRACT

A percussion-ignitable type tube primer has a closed end, thin walled metal tube, which is longitudinally indented over a portion of its length. The indention of the metal tube defines a convex anvil in the interior of the tube. The indented portion of the tube contains a percussively-ignitable primer mixture which ignites and deflagrates when the wall of the tube opposite the convex anvil is deformed by an impact or blow occasioned by a striking hammer or a pin. The primer is made by introducing a fluid paste of the primer mixture into the tube, indenting the tube and subsequently drying the primer mixture.

2 Claims, 13 Drawing Figures

TUBE PRIMER

BACKGROUND OF THE INVENTION

This invention relates to percussion-ignitable primers.

As discussed in "The Gun and Its Development," 9th edition, by W. W. Greener, at pages 116–117, tube primers were known in the early 19th century. A tube primer in general use during this period comprised a tube filled with a detonating powder, the tube being adapted to be placed in the touch hole of a gun and exploded by a blow of the cock on the side of the tube. This form of tube primer did not include an anvil and required support for the lower surface of the tube opposite the cock.

A more recent development in the primer art is the tube primer utilized in flash cubes introduced in the last decade. The construction of this primer, together with its relationship to a flash cube, is depicted in FIGS. 1 and 2. This primer is generally constituted by a metal ignition tube 14 and a wire anvil 16 extending therethrough in coaxial relationship therewith. Upon the wire anvil 16 is a coating 18 of primer material which is spaced from the interior wall of the tube 14 by a narrow clearance. Ignition and deflagration of the primer material coated on the wire anvil 16 is usually beget by a wire striking the tube at right angles to its axis to slightly deform the tube and thereby crush a portion of the material.

An obvious disadvantage in the above described primer construction is that two elements must be provided, viz.: The metal tube and the wire anvil. In addition, structure must be provided for centering the anvil properly within the tube to insure ignition thereof when the tube is struck. Moreover, in such a primer the only passage for the flame to proceed through is that annular space between the outer periphery of the anvil and the inner periphery of the tube. Furthermore, it has been found that when a primer such as that shown in FIG. 1 is employed to ignite a delay cord, there is a tendency for the primer to blow off the cord due to over-pressurization.

SUMMARY OF THE INVENTION

A primer of the invention has a thin metallic tube with an indented case wall on one side thereof to define an anvil in the interior of the tube. A percussion-ignitable primer mixture is contained in the indented portion of the tube and is adapted to be ignited by striking the wall of the tube opposite the anvil by means such as a striking hammer or pin.

A primer of the invention may be manufactured in a facile manner. First, the tube is filled with a solvent slurry of percussion-ignitable primer mixture. Second, the tube is indented in such a manner as to define an anvil in the interior thereof. Third, the wet primer mixture is permitted to dry with or without the addition of heat to thereby produce a solid primer mixture.

A primer of the invention is advantageous in a number of respects. Since the anvil is constituted by the interior wall of the tube, the provision of a separate anvil within the tube is obviated. Also, there is no restriction of the passage through which the flame propagates as the wire anvil is omitted. Furthermore, by indenting the tube, there is less likelihood that the interior thereof will be over-pressurized since the primer may readily expand in the indented portion thereof. It is contemplated that a primer of the invention will find utility in devices such as flash bulbs, burglar alarms, safety systems, and ordnance devices.

Accordingly, it is a primary object of the invention to provide a tube primer in which the anvil is formed by an indention in the wall thereof.

Another object is to provide a primer which is resistant to over-pressurization such that it will not shatter or blow off its mating part upon actuation.

Yet another object is to provide a primer which consists essentially of a tube and a percussion-ignitable primer mixture contained therein.

A still further object is to provide a tube primer which may be actuated by a force perpendicular to its axis.

A still further object of the invention is to provide a minimal cost tube primer.

These and other objects and advantages of the invention will become more readily apparent from the following detailed description, taken in conjunction with the accompanying drawings.

DESCRIPTION OF PREFERRED EMBODIMENTS

Figure 1:
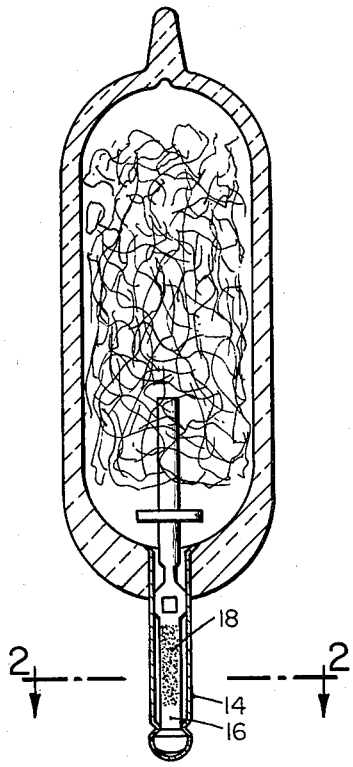
FIG. 1 (PRIOR ART)
FIG. 1 is a cross sectional view of a flash bulb incorporating a state of the art tube primer.
Figure 2:
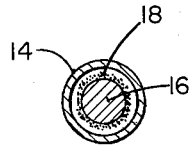
FIG. 2 (PRIOR ART)
FIG. 2 is a sectional view of the tube primer of FIG. 1, taken along the line 2—2 of FIG. 4.
Figure 3:
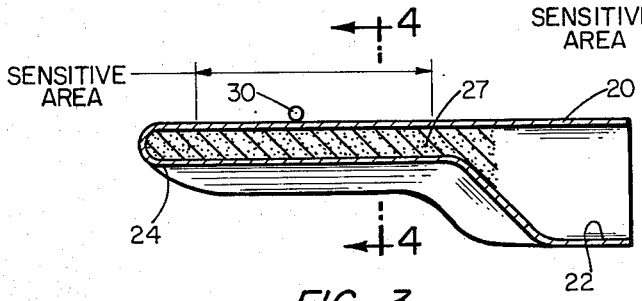
FIG. 3 is a side elevational view, in section, of a first embodiment of a tube primer according to the invention.
Figure 4:
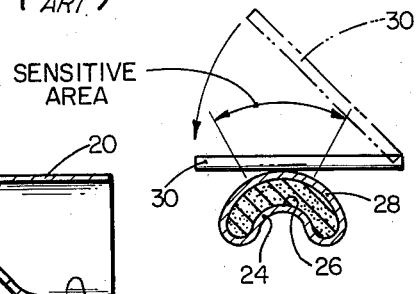
FIG. 4 is a sectional view of the indented portion of the primer of FIG. 3 taken along the line 4—4 of FIG. 3.

Referring to FIGS. 3 and 4, a tube primer according to the invention comprises a thin walled tube 20 which is made of a ductile, deformable metal, such as a nickel chromium iron alloy. The wall of the tube 20 may, for example, be of a thickness of the order of 0.003 inches. The right end of the tube 20 is open to thereby define a mouth 22 for flame propagation upon actuation of the primer. The left portion of the tube 20 is indented in such a manner as to form a longitudinally extending exterior flute 24 which defines an integral longitudinally extending convex anvil 26 in the interior of the tube which is generally coextensive with the longitudinal flute 24. The tube 20 is thus constituted by a closed end fluted section and an open ended cylindrical section.

The interior space of the fluted section is filled with a quantity of percussion-ignitable primer mixture 27 adapted to ignite and deflagrate when the outer surface of the opposing wall 28 confronting the anvil 26 is struck so as to deform the opposing wall and crush the primer mixture interposed therebetween. The anvil 26 is spaced a small distance from the interior periphery of the opposing wall (for example, about 0.005 inches) such that only a small deformation of the opposing wall is necessary to crush the primer mixture in the area adjacent to where the blow is struck.

The primer of FIG. 3 is preferably actuated in the conventional manner by impact with a wire 30 pivoted at 32 (FIG. 4) for movement in a plane perpendicular to the axis of the tube 20. As shown in FIGS. 3 and 4, a sensitive area is defined on the opposing wall 28 which extends longitudinally of anvil 26 and encompasses a small distance to either side of the apex of the anvil 26. The sensitive area has a longitudinal length (depicted in FIG. 3) which extends from a location spaced from the closed end of the tube 20 to a location just before the flute 24 begins to merge with the cylindrical portion of the tube 20. It is, of course, highly desirable to have the wire 30 positioned to apply a blow to the opposing wall 28 in the center of the sensitive area, as generally depicted in FIGS. 3 and 4, although it will be appreciated that a blow of sufficient force anywhere along the portion of the primer containing the primer mixture 27 will cause the primer to fire.

As shown in FIG. 4, the wire 30 is adapted to proceed from the rest position, depicted in phantom, in which it is biased in the direction of the tube 20 by either its own resiliency or other means, to a position in which the opposing wall 28 is contacted (the deformation of wall 28 not being shown). Obviously, the momentum of the wire 30 must be sufficient to deform the opposing wall 28 the extent necessary to crush the primer mixture lying immediately therebeneath, which action actuates the tube primer.

Figure 5:
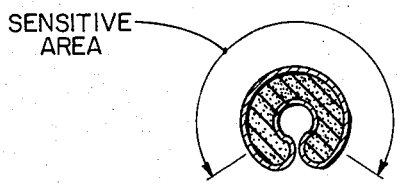
FIG. 5 is a cross section of another embodiment of the invention.
Figure 6:
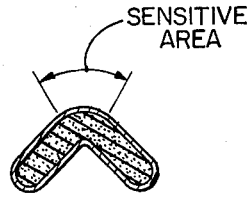
FIG. 6 is a cross section of yet another embodiment of the invention.

FIGS. 5 and 6 illustrate different shapes which the tube may be caused to assume. The indented segment of the tube 20 may be subjected to a mechanical swaging operation to cause it to assume the generally circular shape of FIG. 5. The swaging operation must be performed before the primer mixture solidifies, as will be explained hereinafter. Two advantages of the configuration of FIG. 5 over that of FIG. 3 are a reduction in diameter and an increase in the arcuate length of the sensitive area of the opposing wall. The indented portion of the tube may also assume a shape as shown in FIG. 6. In FIG. 6, it will be noted that the apex of the anvil is somewhat pointed since the flute has a generally triangular cross section. This is advantageous because the impact force of the firing hammer or pin is concentrated upon a smaller area which, because of its triangular cross section, is more resistant to deformation than a cylindrical surface. It will be appreciated that, in this configuration, the sensitive area is reduced; however, by properly positioning the primer in relationship to the firing pin or hammer, reliable firing is assured.

Figure 7:
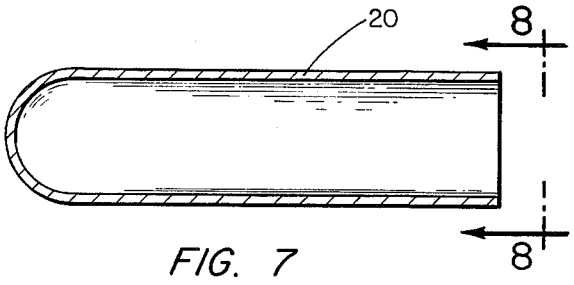
FIG. 7 is a side elevational view of a tube which is to be made into a primer of the invention.
Figure 8:
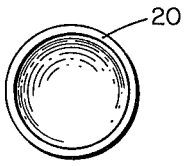
FIG. 8 is an end view of the tube of FIG. 7, taken along the line 8—8 of FIG. 7.
Figure 9:
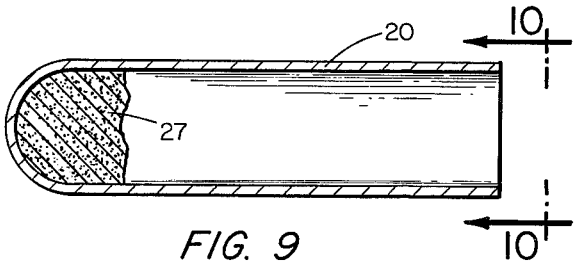
FIG. 9 is a view similar to that of FIG. 7, showing the tube filled with a solvent slurry of percussion-ignitable primer mixture adjacent to the closed end thereof.
Figure 10:
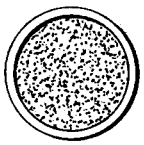
FIG. 10 is an end view of the tube taken along the 10—10 of FIG. 9.
Figure 11:
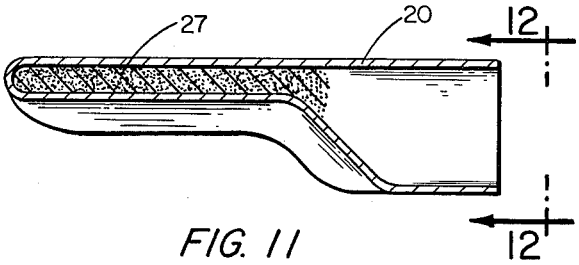
FIG. 11 is a view of the tube of FIG. 9 after a portion of a tube has been indented to form an anvil in the interior thereof.
Figure 12:
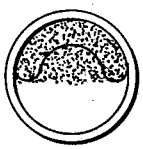
FIG. 12 is an end view of the tube of FIG. 11, taken along the line 12—12 of FIG. 11.

A preferred method of making a tube primer according to the invention may best be understood by reference to FIGS. 7 through 12. The empty metal tube 20 of FIGS. 7 and 8 is partially filled adjacent to closed end thereof with a solvent slurry of primer mixture 27. In the fluid state, the primer mixture 27 is stable and hence not ignitable upon deformation of the tube 20. The tube 20 of FIGS. 9 and 10 may thereby be safely indented as desired, as long as the primer mixture 27 remains in paste form. The tube of FIGS. 9 and 10 is then indented in such a manner as to cause it to assume the shape of FIGS. 11 and 12. The indentation of the tube 20 causes the primer mixture 27 to be extruded in the direction towards the mouth 22. The amount of primer mixture 27 deposited in the interior volume of the tube 20 is dependent upon the characteristics and the desired length of indentation. Also, the amount and composition of primer mix may be varied to produce a brisant or hard ignition, or a soft ignition having little shock. The tube is now subjected to heat or a vacuum to remove the liquid in the primer mixture 27 and produce a solid primer mixture. The primer mixture may also be dried by merely exposing the tube to the air.

A primer of the invention may also be manufactured by spraying the slurry directly into the tube 20 so as to coat a portion of the interior wall thereof and subsequently indenting the tube. Moreover, if desired, the tube may be first indented and the slurry sprayed therein, although the material will then be required to pass down a very small gap.

Figure 13:
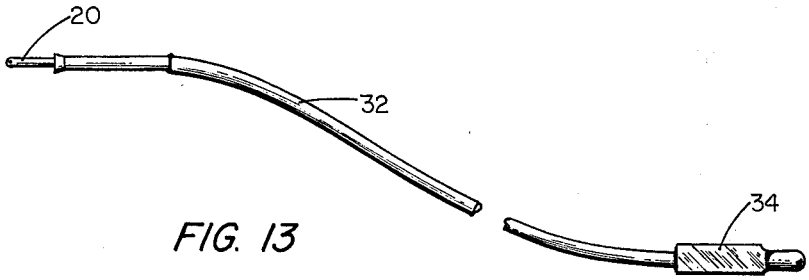
FIG. 13 shows the utilization of a primer of the invention in conjunction with a delay cord having an output charge at the other end thereof.

A tube primer of the invention is particularly well suited for fuze applications. For example, FIG. 13 shows a tube primer of FIG. 3 attached to a metal sheath delay cord 32 which in turn is connected to an actuator 34, containing a gasless ignition charge. It will be noted that the tube primer may be directly cemented or crimped to the delay cord 32 and that since the primer contains no separate anvil, there is no structure to restrict the passage of flame from the primer directly into the core of the delay cord 32. In addition, since the primer is expandable (by distension of the indentation upon a sufficient increase in pressure in the interior volume of the primer) there is little likelihood that excessive pressures will develop in the interior volume of the tube which may otherwise blow the primer off the delay cord. The delay cord and actuator arrangement, as shown in FIG. 13, may be incorporated in numerous ordnance devices such as hand grenades.

An example of a preferred primer mixture which exhibits the desired safety and sensitivity characteristics is that composition known in the art as "Armstrong's Mixture", as modified by the addition of a gritty substance, such as boron carbide. More specifically, a preferred primer mixture, exclusive of the solvent, may be constituted by the following composition in percentages by weight of: 70 percent potassium chlorate, 19 percent red phosphorus, 3 percent sulphur, 3 percent precipitated chalk, and 5 percent boron carbide. However, it will be appreciated that numerous other compositions could be employed to carry out the invention.

While only a few embodiments of the invention have been set forth hereinabove, it will be understood that changes and modifications may be made thereto without departing from the spirit and scope of the invention, as defined in the subjoined claims.

What is claimed is:

1. A tube primer comprising:

a deformable metal tube having an indented portion defining a longitudinally extending, convexlyshaped anvil integrally formed in the wall of the tube and in the interior volume thereof;

a percussion-ignitable primer mixture contained in the indented portion of the tube such that the wall of the tube opposite the anvil may be deformed to crush and thereby ignite and deflagrate the primer mixture.

2. A tube primer, as defined in claim 1, wherein the indented portion of the tube is generally cylindrical.

* * * * *